US006902517B1

(12) United States Patent
Brown et al.

(10) Patent No.: US 6,902,517 B1
(45) Date of Patent: Jun. 7, 2005

(54) SAFETY BARBELL WEIGHT

(75) Inventors: Sean D. Brown, Alliston (CA); Sheila M. Brown, Alliston (CA)

(73) Assignees: Sean Douglas Brown, Alliston (CA); Sheila May Brown, Alliston (CA)

( * ) Notice: Subject to any disclaimer, the term of this patent is extended or adjusted under 35 U.S.C. 154(b) by 0 days.

(21) Appl. No.: 10/445,450

(22) Filed: May 28, 2003

(51) Int. Cl.[7] ..... A63B 21/072
(52) U.S. Cl. ..... 482/107; 482/106; D21/681
(58) Field of Search ..... 482/104, 106–109, 482/93; D21/681

(56) References Cited

U.S. PATENT DOCUMENTS 4,655,388 A * 4/1987 Fleming ..... 206/126
4,665,388 A * 5/1987 Ivie et al. ..... 340/573.1
5,048,826 A * 9/1991 Ryan ..... 482/7
6,749,538 B2 * 6/2004 Slawinski et al. ..... 482/44
6,793,607 B2 * 9/2004 Neil ..... 482/8

* cited by examiner

*Primary Examiner*—Justine R. Yu
*Assistant Examiner*—Tam Nguyen

(57) ABSTRACT

The safety barbell weight is a personal training product that would make a free weight workout safer and more effective. The safety barbell weight would consist of a U-shaped collar slideably mounted on a weight. The weight would have a concavity that forms a circular aperture when paired with the collar. The collar would have a groove cut in one leg into which stop pins would be inserted to prevent the weight from coming completely off the bar. The stop pins could take the form of a safety screw and a spring-loaded screw wherein the spring loaded screw would release under the desired load and allow the collar to slide out of the weight. The safety screw would catch on a divider in the groove to prevent the weight from falling off the bar.

20 Claims, 4 Drawing Sheets

SAFETY BARBELL WEIGHT

BACKGROUND OF THE INVENTION

1. Field of the Invention

The present invention relates to a safety and performance enhancement for use in connection with barbell weights. The safety barbell weight has particular utility in connection with increasing the safety and effectiveness of a free weight workout by promoting proper form during the workout, thereby reducing injuries suffered by individuals participating in weight training.

2. Description of the Prior Art

Personal weight training has recently gained in popularity with fitness enthusiasts. In addition, weight training is often incorporated into the workout regimen for various athletic endeavors. Free weights are typically loaded on a barbell prior to the commencement of an exercise. Various free weight exercises, such as curls, bench or military presses, rows, triceps, and extensions, are popular among fitness enthusiasts and athletes who are attempting to increase strength and muscle mass. Unfortunately, it is easy to perform many of these exercises incorrectly. Common errors, such as going too fast or making quick, jerky movements, reduce the benefit and effectiveness of the exercise and can cause injuries. Therefore, a barbell weight that could be easily mounted on a conventional barbell and provide an immediate feedback to the user when an exercise is performed incorrectly would not only alert the user to an incorrect form, allowing him to correct and maintain his form for the remainder of the workout set, but also reduce the likelihood that he will injure himself.

The use of safety weights is known in the prior art. For example, U.S. Pat. No. 6,039,678 to Fredric O. Dawson discloses a dumbbell set with quick release plates that includes at least one dumbbell with a handle bar, a plurality of rectangular weight plates, a top plate to prevent the weights from falling off the handle bar, and a weight storage rack. The weight plates each have a slot and are stacked on the threaded stack and then tightened against the stop plate. However, the Dawson '678 patent does not provide a means by which the user is alerted when exercises are not performed correctly. Furthermore, the Dawson '678 device could not be used with existing weightlifting bars since it utilizes a specialized threaded shaft, necessitating the purchase of an entire new weight system. Finally, changing the weight plates of the Dawson '678 device requires the weightlifter to have sufficient hand strength to securely tighten and subsequently loosen a tightened disk at the end of the weight bar. If an individual failed to sufficiently tighten the weight plates against the stop plate, the weights could easily slip from the bar, and once tightened, the disk could be hard to loosen.

U.S. Pat. No. 5,879,274 to E. Michael Mattox discloses a dumbbell assembly that includes a pair of cage receptacles rigidly secured to the ends of a weight bar for securing weight plates to the bar. One embodiment of the Mattox '274 device features a weight bar wherein springs force each of two platters toward one of the outer ends of the bar for the purpose of securing the weighted plates within each of the receptacles. A second embodiment of the Mattox '274 device includes a handle bar that is integrally molded or rigidly secured to the two-part caged receptacles which easily open for insertion or removal of weight plates. The two parts of each receptacle are secured by an elastomeric band. However, the Mattox '274 patent does not provide a mechanism for alerting the weightlifter when an exercise is being performed improperly. Additionally, the Mattox '274 device can not be used with existing weight bars and would require the increased cost of purchasing an entire weight system. Lastly, if the elastomeric band holding the weight plates of the Mattox '274 device were to break or slip due to improper placement, the user or nearby individuals could be injured.

Similarly, U.S. Pat. No. 1,779,594 to David C. Hall discloses an exercising device that includes a weight bar having end portions with rectangular cross section, stop and partition disks mounted on these end sections to provide partitions of these sections, and weights which are fitted between these partitions. These weights have a special seating mechanism consisting of slots cut radially to the center of the weight and spring actuated grapples which hold the weights to the bar. However, the Hall '594 patent fails to provide a mechanism for alerting the weight lifter when an exercise is not performed correctly. Furthermore, the Hall '594 device requires the purchase of an entire weight system since it can not be used with either existing weights or an existing weight bar.

U.S. Pat. No. 4,893,810 to Scott H. Lee discloses a quick release collar for a weight lifting barbell that includes a collar body, an axially movable sleeve, and a plurality of radially movable balls frictionally engaged with the bar and positionally controlled by a tension ring. A coil spring biases the sleeve and tension ring toward a locked position in which the movable balls securely engage the bar. However, while the Lee '810 patent provides an easy release locking mechanism, it fails to provide a mechanism for alerting the user when a weight lifting exercise is performed incorrectly. Additionally, if the Lee '810 device were not properly engaged, the weight lifter or bystanders could be injured due to falling weights.

Likewise, U.S. Pat. No. 5,048,826 to William C. Ryan discloses a safety apparatus for use with a barbell assembly that includes a support frame, a pair of cables securable to opposite ends, of the assembly, a winch assembly for retracting and releasing the cables, a pair of tension sensors, a velocity sensor, and a controller for the winch assembly. The controller is responsive to the velocity and tension sensors for normally releasing and retracting the cables during a weight lifting routine and for detecting an abnormal condition during an exercise and controlling the weight of the barbell assembly to reduce the risk of injury to the weightlifter. However, the Ryan '826 patent is limited in use to specific types of exercises, such as bench presses, where the weight is lifted straight up and down. In addition, the Ryan '826 device is complex and adds specialized equipment which would drive up the price for consumers. Finally, the Ryan '826 device is not easily portable; thus, an individual could not easily move the device to different weightlifting facilities.

Lastly, U.S. Pat. No. 5,217,421 to Ronald S. Chrysler discloses a portable safety device for weight training that consists of a metal frame releasably mounted on a weight training bench for the purpose of protecting the user's head from a dropped weight during bench press exercises. However, the Chrysler '421 patent does not alert the weightlifter if an exercise is performed incorrectly. Furthermore, the Chrysler '421 device is suitable for use in only a limited number of weight lifting exercises. Finally, the Chrysler '421 device fails to provide a mechanism for securing the weights to the bar, leaving nearby individuals and the remainder of the user's body open to possible injury from falling weights.

While the above-described devices fulfill their respective, particular objectives and requirements, the aforementioned patents do not describe a safety barbell weight that promotes proper form during the workout, thereby reducing injuries suffered by individuals participating in weight training. The Dawson '678, Mattox '274, Hall '594, Lee '810, and Chrysler '421 patents fail to provide a mechanism by which the weight lifter is alerted if an exercise is being performed improperly. Furthermore, the Dawson '678, Mattox '274, and Hall '594 devices can not be used with either existing weight bars or weights and require the user to invest in a completely new set of weight lifting equipment. Changing the weight plates of the Dawson '678 device requires the weightlifter to have sufficient hand strength to securely tighten and subsequently loosen a tightened disk at the end of the weight bar. If an individual failed to sufficiently tighten the weight plate of the Dawson '678 device, it could easily slip from the bar and injure the weight lifter or a bystander. In addition, failure to properly secure the elastomeric bands of the Mattox '274 bands or the Lee '810 collar could lead to injury from falling weights. Moreover, the Chrysler '421 patent fails to provide a mechanism for securing the weights to the bar, leaving nearby individuals and the remainder of the user's body open to possible injury from falling weights. Both the Ryan '826 and Chrysler '421 devices are suitable for use in only a limited number of weight lifting exercises. Finally, the Ryan '826 device is not easily portable and is complex with specialized equipment that would drive up the cost to the consumer.

Therefore, a need exists for a new and improved safety barbell weight that can be used with existing weight bars to provide an easily releasable weight that promotes proper form during the workout, thereby reducing injuries suffered by individuals participating in weight training. In this regard, the present invention substantially fulfills this need. In this respect, the safety barbell weight according to the present invention substantially departs from the conventional concepts and designs of the prior art, and in doing so provides an apparatus primarily developed for the purpose of promoting proper form during weight training, thereby reducing injuries suffered by individuals participating in weight lifting exercises.

SUMMARY OF THE INVENTION

In view of the foregoing disadvantages inherent in the known types of safety weights now present in the prior art, the present invention provides an improved safety barbell weight, and overcomes the above-mentioned disadvantages and drawbacks of the prior art. As such, the general purpose of the present invention, which will be described subsequently in greater detail, is to provide a new and improved safety barbell weight and method which has all the advantages of the prior art mentioned heretofore and many novel features that result in a safety barbell weight which is not anticipated, rendered obvious, suggested, or even implied by the prior art, either alone or in any combination thereof.

To attain this, the present invention essentially comprises a symmetrical weight with a U-shaped collar slideably attached to the weight and positionally controlled by a stop screw and a spring screw which slide through a series of grooves on the collar to define an open and closed position for the collar. The spring screw is activated when a weight imbalance is detected, typically due to improper weightlifting form, and the stop screw prevents the collar from becoming completely detached from the weight.

There has thus been outlined, rather broadly, the more important features of the invention in order that the detailed description thereof that follows may be better understood and in order that the present contribution to the art may be better appreciated.

A plurality of the safety barbell weights could also be offered with a weightlifting bar. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety barbell weight that has all of the advantages of the prior art safety weights and none of the disadvantages.

It is another object of the present invention to provide a new and improved safety barbell weight that may be easily and efficiently manufactured and marketed.

An even further object of the present invention is to provide a new and improved safety barbell weight that has a low cost of manufacture with regard to both materials and labor, and which accordingly is then susceptible of low prices of sale to the consuming public, thereby making such a safety barbell weight economically available to the buying public.

Still another object of the present invention is to provide a new safety barbell weight that provides in the apparatuses and methods of the prior art some of the advantages thereof, while simultaneously overcoming some of the disadvantages normally associated therewith.

Even still another object of the present invention is to provide a safety barbell weight for alerting the user when a weightlifting exercise is executed with improper form. This provides instant feedback to the weightlifter, allowing him to immediately correct his form and increasing the effectiveness of the exercise.

Yet another object of the present invention is to eliminate the repetition of incorrect form for weightlifting exercises. This reduces the injuries that a weightlifter might incur from improper form and eliminates the possibility of developing poor habits during weightlifting.

Lastly, it is an object of the present invention to provide a new and improved safety barbell weight that is portable and easy to use. This allows the weightlifter to easily attach the weight to standard weightlifting bars and to transport the device to any weightlifting location.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
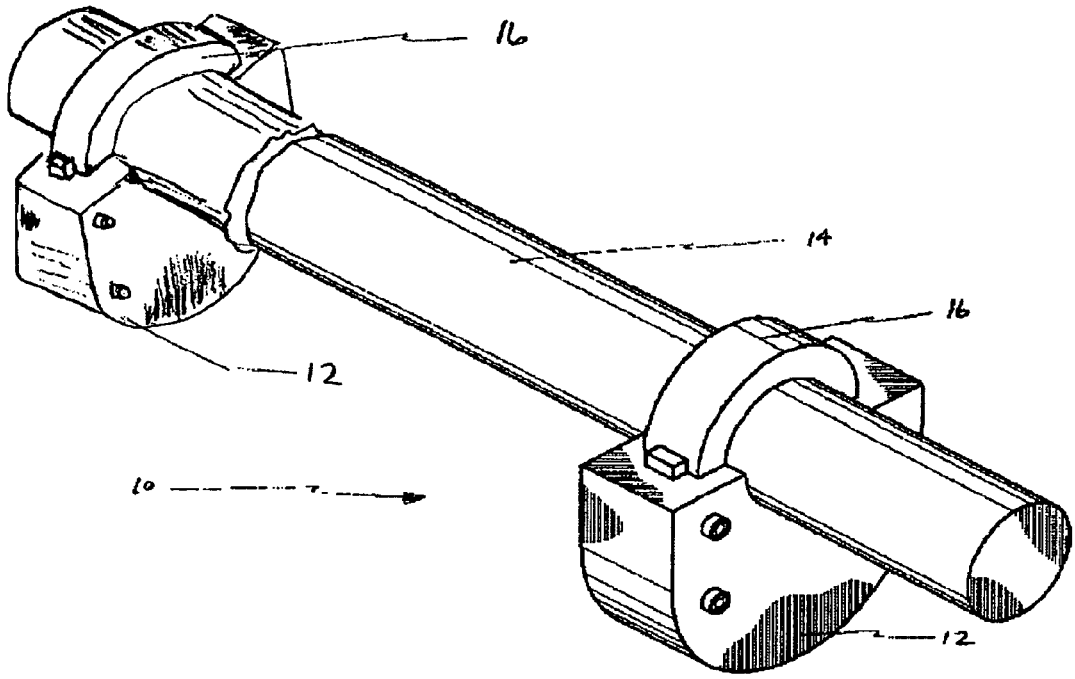
FIG. 1 is a front perspective view of the preferred embodiment of the safety barbell weight constructed in accordance with the principles of the present invention.

Referring now to the drawings, and particularly to FIGS. 1–4, a preferred embodiment of the safety barbell weight of the present invention is shown and generally designated by the reference numeral 10.

In FIG. 1, a new and improved safety barbell weight 10 of the present invention for promoting proper form during weight training is illustrated and will be described. More particularly, the safety barbell weight 10 has a semi-elliptical weight 12 mounted on a weight lifting bar 14 with a metal collar 16 that curves over the weight bar 14 and extends on both ends into the weight 12. The weight could take several shapes, such as rectangular, semi-circular, and other symmetrical shapes which would balance equal amounts of weight radially along. One or more of these weights 10 could be positioned along the weight bar 14 to achieve the desired weight configuration.

Figure 2:
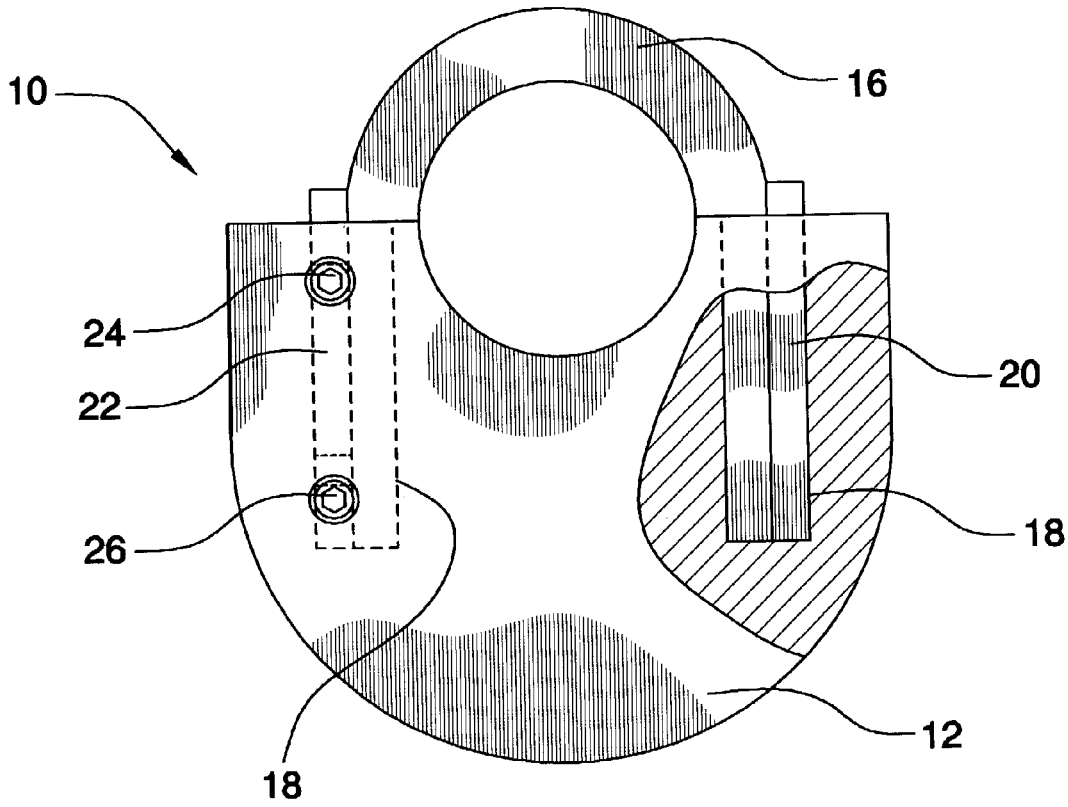
FIG. 2 is a front view of the safety barbell weight of the present invention.

FIG. 2 portrays the sliding mechanism of the safety barbell weight 10. The weight 12 has a chamber 18 formed into each side. The collar 16 is U-shaped with each rectangular leg extending into one of these chambers 18. A rectangular collar foot 20 is slideably embedded in the first of these chambers 18 and extends slightly above the weight 12. A control collar foot 22 is slideably embedded in the second chamber 18 and extends slightly above the weight 12, as does the first collar foot 20. The control collar foot 22 is connected to the weight 12 by a safety screw 24 and a spring screw 26. The function of these screws is described in FIGS. 3 and 4.

Figure 3:
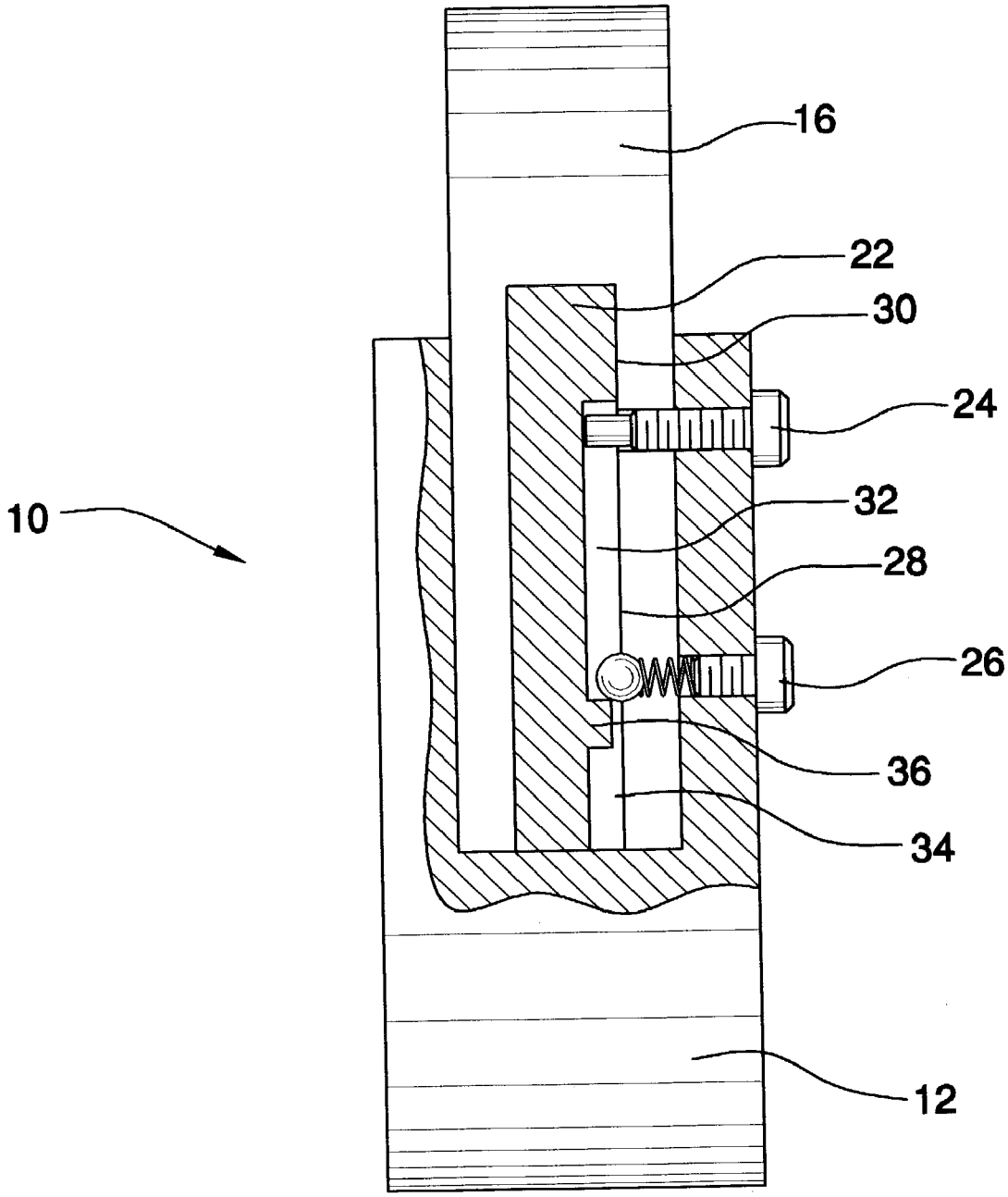
FIG. 3 is a left side cutaway cross sectional view of the closed safety barbell weight of the present invention.
Figure 4:
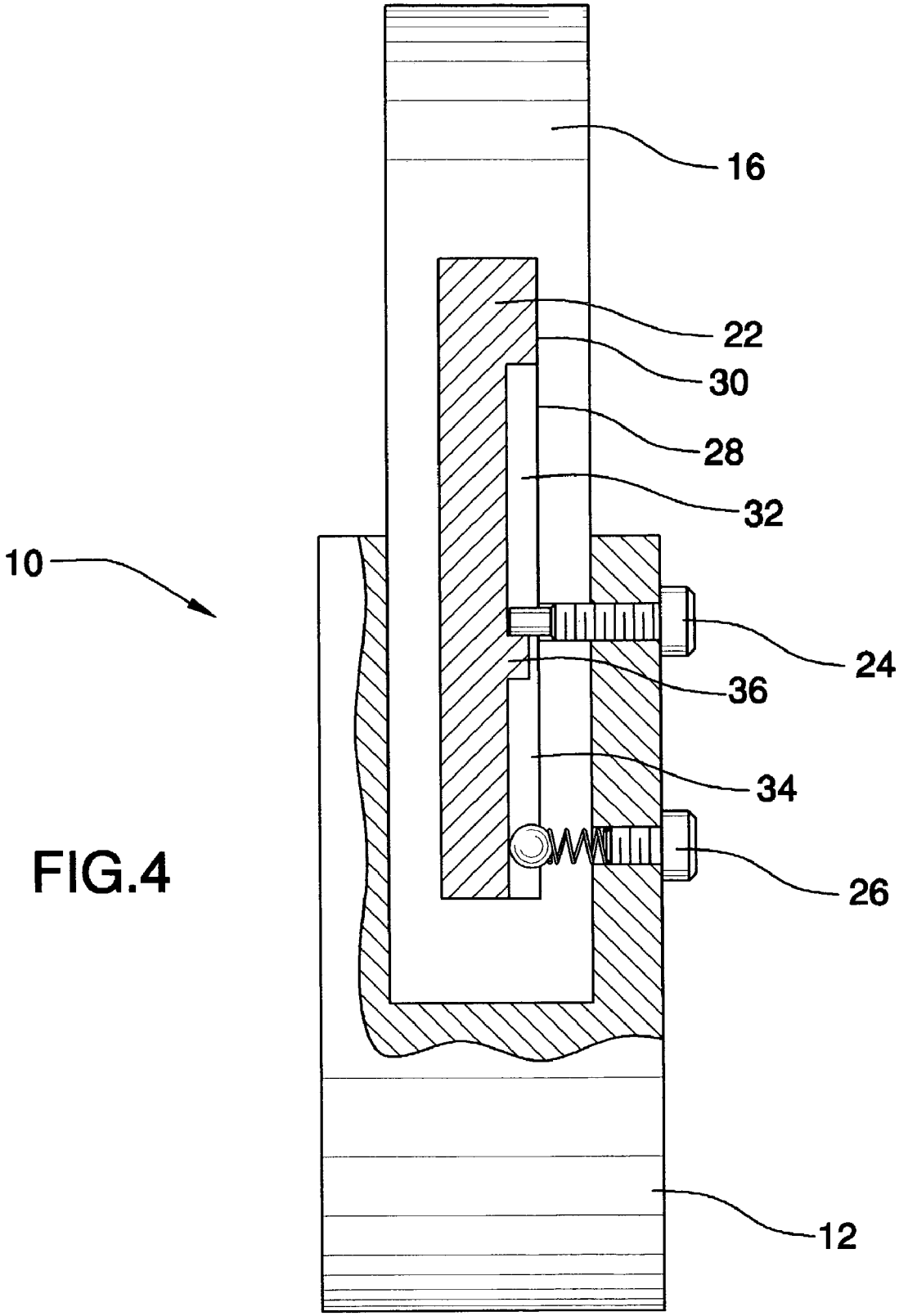
FIG. 4 is a left side cutaway cross sectional view of the open safety barbell weight of the present invention.

FIG. 3 shows the closed collar 16 and weight 12, and FIG. 4 shows the open collar 16 and weight 12. The control collar foot 22 has a groove 28 cut into the front surface 30. This groove 28 is bisected into an upper portion 32 and a lower portion 34 by a divider 36. When closed, the safely screw 24 extends into the top of the upper portion 32 of the groove 28, and the spring screw 26 extends into the bottom of the upper portion 32 of the groove 28. During a weight lifting exercise, if the user moves slowly and smoothly, the spring screw 26 remains in the upper portion 32 of the groove 28 and maintains the closed position of the collar 16. If the weight lifter moves too quickly or changes directions suddenly, the spring screw 26 slips out of the upper portion 32 of the groove 28 and slides to the lower portion 34 of the groove 28 as shown in FIG. 4. The safety screw 24 catches against the divider 36 to prevent the weight from falling off the weight bar 14. This provides immediate feedback to the user on each repetition of the exercise, helping him maintain proper form throughout the exercise.

In use, it can now be understood that the user would mount one weight 12 on each end of a weight lifting bar 14, making certain that the collar 16 is placed in the closed position. The user would then proceed to engage in weight-lifting exercises. At any time if the user moves too quickly, jerks the weights, or unbalances the weights 12 through sudden direction changes, the spring screw 26 releases from the upper portion 32 of the groove 28 under the additional pressure and catches in the lower portion 34 of the groove 28. This causes the collar 16 to open, alerting the user to improper weightlifting form, but stops the collar 16 from completely detaching from the weight 12. The user would then reset the collar 16 in the closed position and proceed with the exercise, attempting to correct the improper form.

While a preferred embodiment of the safety barbell weight has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or a variety of wood may be used for the collar described. Furthermore, a wide variety of weightlifting bars of varying dimensions could be used interchangeably with the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A safety barbell weight comprising:

a symmetrical weight having a front surface formed with a plurality of vertically aligned transverse apertures, a rear surface, a top formed with a concave arc, and a line of symmetry dividing said weight into a first half formed with a slot commencing at said top and having an inner wall and an outer wall and aligned with said plurality of transverse apertures and a second half formed with a similar slot commencing at said top and having an inner wall and an outer wall wherein said inner walls are closer to said line of symmetry than are said outer walls;

a U-shaped collar having a first leg, an arch, and a second leg and slideably connected to said weight wherein said first leg slides into said slot of said first half of said weight, said arch forms a circular opening with said concave arc of said weight, and said second leg slides into said slot of said second half of said weight;

a first collar foot formed with a groove bisected by a divider into an upper portion and a lower portion and connected to said first leg of said collar and slideably connected to said outer wall of said slot of said first half of said weight;

a safety screw having a head and an end and connected to said front surface of said weight wherein said end of said screw passes through one of said plurality of transverse apertures in said front surface of said weight and said end resides in said upper portion of said groove in said first collar foot;

a spring screw having a top, a middle, and an end, with a head forming the top of the screw, a spring forming the middle of the screw, and a ball forming the end of the screw and connected to said front surface of said weight wherein said ball end of said screw is inserted through one of said plurality of transverse apertures in said front surface of said weight located below said transverse aperture through which said safety screw passes and said ball resides in said upper portion of said groove in said first collar foot defining a closed position for said collar; and a second collar foot slideably connected to said outer wall of said slot of said second half of said weight and to said second leg of said collar.

2. The safety barbell weight of claim 1 wherein said slots formed in said first and said second halves of said weight are rectangular in shape.

3. The safety barbell weight of claim 2 wherein said first and said second leg of said collar are rectangular in shape.

4. The safety barbell weight of claim 2 wherein said first and said second collar foots are rectangular in shape.

5. The safety barbell weight of claim 1 wherein said first collar foot extends slightly above said top of said weight.

6. The safety barbell weight of claim 1 wherein said second collar foot extends slightly above said top of said weight.

7. The safety barbell weight of claim 1 wherein said spring of said spring screw compresses when said weight is moved in a sudden, jerky motion or when said weight quickly changes directions signifying that a weight exercise is not being performed with correct form.

8. The safety barbell weight of claim 7 wherein said ball of said spring screw moves toward said head of said spring screw, exits said upper portion of said groove in said first collar foot, moves past said divider, and is inserted into said lower portion of said groove in said first collar foot, allowing said first and said second legs of said collar to slide towards said top of said weight, when correct form is not used in a weight exercise and defining an open position for said collar.

9. The safety barbell weight of claim 8 wherein said divider of said groove of said first collar foot catches on said safety screw when said collar is in said open position and prohibits said first leg of said collar from exiting said slot in said first half of said weight.

10. Safety barbell weight apparatus comprising:

a plurality of symmetrical weights having a front surface formed with a plurality of vertically aligned transverse apertures, a rear surface, a top formed with a concave arc, and a line of symmetry dividing said weight into a first half formed with a slot commencing at said top and having an inner wall and an outer wall and aligned with said plurality of transverse apertures and a second half formed with a similar slot commencing at said top and having an inner wall and an outer wall wherein said inner walls are closer to said line of symmetry than are said outer walls;

a plurality of U-shaped collars having a first leg, an arch, and a second leg and slideably connected to said plurality of weights wherein said first leg of each said collar slides into said slot of said first half of a different said weight, said arch forms a circular opening with said concave arc of said weight, and said second leg slides into said slot of said second half of said same weight as said first said leg;

a first plurality of collar braces formed with a groove bisected by a divider into an upper portion and a lower portion and each said collar brace connected to a different said first leg of said collar and slideably connected to said outer wall of said slot of said first half of said weight into which said first leg of said collar is inserted;

a plurality of safety screws having a head and an end and each connected to said front surface of a different said weight wherein said end of said screw passes through one of said plurality of transverse apertures in said front surface of said weight and said end resides in said upper portion of said groove in said first collar brace;

a plurality of spring screws having a top, a middle, and an end, with a head forming the top of said spring screw, a spring forming the middle of said spring screw, and a ball forming the end of said spring screw and each connected to said front surface of a different said weight wherein said ball end of said spring screw is inserted through one of said plurality of transverse apertures in said front surface of said weight located below said transverse aperture through which said safety screw passes and said ball resides in said upper portion of said groove in said first collar brace defining a closed position for said collar;

a plurality of second collar braces, each slideably connected to said outer wall of said slot of said second half of a different said weight and to said second leg of said collar; and a cylindrical weightlifting bar connected to said plurality of weights and to said plurality of collars wherein said bar passes between said circular opening formed between said collar and said weight.

11. The safety barbell weight of claim 10 wherein said slots formed in said first and said second halves of said plurality of weights are rectangular in shape.

12. The safety barbell weight of claim 11 wherein said first and said second leg of said collar are rectangular in shape.

13. The safety barbell weight of claim 11 wherein said plurality of first and second collar braces are rectangular in shape.

14. The safety barbell weight of claim 10 wherein said first collar brace extends slightly above said top of said weight.

15. The safety barbell weight of claim 10 wherein said second collar brace extends slightly above said top of said weight.

16. The safety barbell weight of claim 10 wherein said spring of said spring screw compresses when said weight is moved in a sudden, jerky motion or when said weight quickly changes directions signifying that a weight exercise is not being performed with correct form.

17. The safety barbell weight of claim 16 wherein said ball of said spring screw moves toward said head of said spring screw, exits said upper portion of said groove in said first collar brace, moves past said divider, and is inserted into said lower portion of said groove in said first collar brace, allowing said first and said second legs of said collar to slide towards said top of said weight, when correct form is not used in a weight exercise and defining an open position for said collar.

18. The safety barbell weight of claim 17 wherein said divider of said groove of said first collar brace catches on said safety screw when said collar is in said open position and prohibits said first leg of said collar from exiting said slot in said first half of said weight.

19. The safety barbell weight of claim 10 wherein said cylindrical weightlifting bar is of the general length used with dumbbells.

20. The safety barbell weight of claim 10 wherein said cylindrical weightlifting bar is of the general length used with barbells.

* * * * *